United States Patent [19]

Dikoff

[11] 4,291,995

[45] Sep. 29, 1981

[54] TOOTHBRUSH WITH RE-FILLABLE PASTE RESERVOIR

[75] Inventor: Joseph K. Dikoff, St. Croix, V.I.

[73] Assignee: Elizabeth A. Tasis, Ft. Lauderdale, Fla.

[21] Appl. No.: 110,401

[22] Filed: Jan. 8, 1980

[51] Int. Cl.[3] ..... A46B 11/02

[52] U.S. Cl. ..... 401/175; 401/286

[58] Field of Search ..... 401/173, 133, 174, 175, 401/286, 287, 180, 154, 135, 190; 132/84 R, 84 B

[56] References Cited

U.S. PATENT DOCUMENTS

| | | | |
|---|---|---|---|
| 1,944,067 | 1/1934 | Collins | 401/175 |
| 2,638,614 | 5/1953 | Anderson | 401/175 X |
| 2,699,889 | 1/1955 | Johnson | 401/175 X |
| 2,814,816 | 12/1957 | Pepping et al. | 401/135 |
| 2,826,174 | 3/1958 | Morse et al. | 401/135 |
| 3,868,188 | 2/1975 | Valardi | 401/175 X |
| 4,145,147 | 3/1979 | Shuck | 401/175 |

*Primary Examiner*—Edward M. Coven

*Attorney, Agent, or Firm*—Bruce L. Birchard

[57] ABSTRACT

By providing a reservoir of variable volume with an integral filling and dispersing spout having a portion with an outer diameter such that the spout will form an interference fit within the dispersing spout of any toothpaste tube and having another portion dimensioned to be coupled to a disposable brush portion having a paste channel therethrough to the bristles a convenient and versatile paste-dispensing toothbrush is realized.

9 Claims, 4 Drawing Figures

TOOTHBRUSH WITH RE-FILLABLE PASTE RESERVOIR

BACKGROUND OF THE INVENTION

1. Field of the Invention

This invention relates to paste-dispensing toothbrushes and, more specifically, to such toothbrushes in which the paste reservoir is manually varied in volume and may be re-filled.

2. Prior Art

A search of the related sub-classes in the files of the U.S. Patent and Trademark Office revealed the following U.S. patents which are of interest but from which the present invention may be distinguished:

U.S. Pat. No. 1,192,668 (Miles)
U.S. Pat. No. 1,944,067 (Collins)
U.S. Pat. No. 2,814,816 (Pepping, et al)
U.S. Pat. No. 3,256,893 (Mc Eachran)
U.S. Pat. No. 2,278,253 (Ellsworth)
French Pat. No. 810,644 (Lavaud)

The Miles patent requires an adapter 26 to couple a toothpaste tube to the flexible tube 18. Such an adapter will invariably be lost by the user rendering the brush useless. Further, flexible tube 18 is twisted by knob 24 to cause toothpaste to be expelled through discharge opening 12. Repeated twisting of tube 18 will cause it to deteriorate rendering the brush of Miles short lived.

The Collins patent, in FIGS. 1–12, is directed to a non-refillable toothbrush. This invention relates to a re-fillable toothbrush. In FIGS. 13–17 Collins shows a re-fillable toothbrush but in each case the toothbrush reservoir has a female connector adapted to engage the male threads on a toothpaste tube nozzle. I have discovered that outer diameters of tube nozzles or spouts vary widely, but inner diameters are standard. Thus, Collins' toothbrush could be filled with a limited line of toothpastes, whereas the brush described in this application could be filled from any toothpaste tube containing toothpaste.

The Pepping patent is directed to a toothbrush with a pressurized cartridge containing toothpaste. It is not a refillable reservoir. Thus its cost is high and its chances for commercial success are low.

The Mc Eachran patent is also directed to a toothbrush in which the paste is moved by a propellant. Relatively movable tubes expose dentifrice escape openings. The device of this patent is relatively complex and expensive to build, in contrast to the practical configuration presented in the present application.

The Ellsworth patent shows a complex and economically impractical structure which again suffers from its inability to be loaded from any toothpaste tube because the patent teaches coupling to the outer threads of the tube, which threads vary in diameter between manufacturers. In my device the structure is significantly simplified by using the body itself as the means for driving the piston forward and backward in addition to assuring universal coupling to toothpaste tubes.

The French patent to Lavaud suffers from the same coupling problem as was described earlier when re-filling from a tube is desired. Further, the helical structure of FIG. 1 is unnecessarily complex and expensive to build.

It is an object of this invention to overcome the problems and disadvantages of the prior art devices.

It is a further object of the present invention to provide an improved paste-dispensing toothbrush which may be re-filled from any available toothpaste tube.

SUMMARY OF THE INVENTION

My invention contemplates providing a hollow, cylindrical body, the inner space thereof having a cross-section which is other than circular, for example, hexagonal. There is further provided a piston having a contour and an external dimension corresponding to the inner contour and dimension of the hollow body, so as to fit slidably within said body. Located centrally in the piston is a threaded opening adapted to cooperate with the similarly threaded worm positioned coaxially in said body and supported at one end in a terminating cap on said body. The other end of said worm terminates in an aperture plate which is secured to a spout portion having a channel therethrough adapted to pass toothpaste into and out of the hollow body through said aperture plate. The body is rotatably secured to the spout portion. As the body is rotated, it rotates the piston which, because of its central threaded opening being in cooperation with the threads of the worm, causes the piston to move from one end of the chamber formed by the body, end cap and aperture plate, to the other end of the chamber. With such piston motion towards the aperture plate, any toothpaste in that chamber is forced out on to the toothbrush bristles through the channel connecting the spout portion and the bristles. To load the chamber with toothpaste, the brush head, which includes the bristles, is removed by rotation, from the larger-diameter threaded section of the spout portion. The spout has an additional smaller-diameter threaded section which be slightly tapered in diameter, if desired, to facilitate its insertion in the opening in a toothpaste tube. Relative rotation of the spout in a tube of toothpaste into which the spout has been inserted will result in a paste-tight engagement between the two. If the inner chamber has been opened by rotation of the body ro retract the piston, paste may be squeezed into the chamber for later extrusion by reverse turning of the body and consequent motion of the piston toward the aperture plate. With the brush head in place, paste is then dispensed to the bristles neatly and in the proper amount.

BRIEF DESCRIPTION OF THE DRAWINGS

The features of the present invention which are believed to be novel are set forth with particularity in the appended claims. The present invention, both as to its organization and manner of operation, together with further objects and advantages thereof, may be best understood by reference to the following description taken in conjunction with the accompanying drawings, in which:

DETAILED DESCRIPTION OF THE PREFERRED EMBODIMENT

Figure 1:
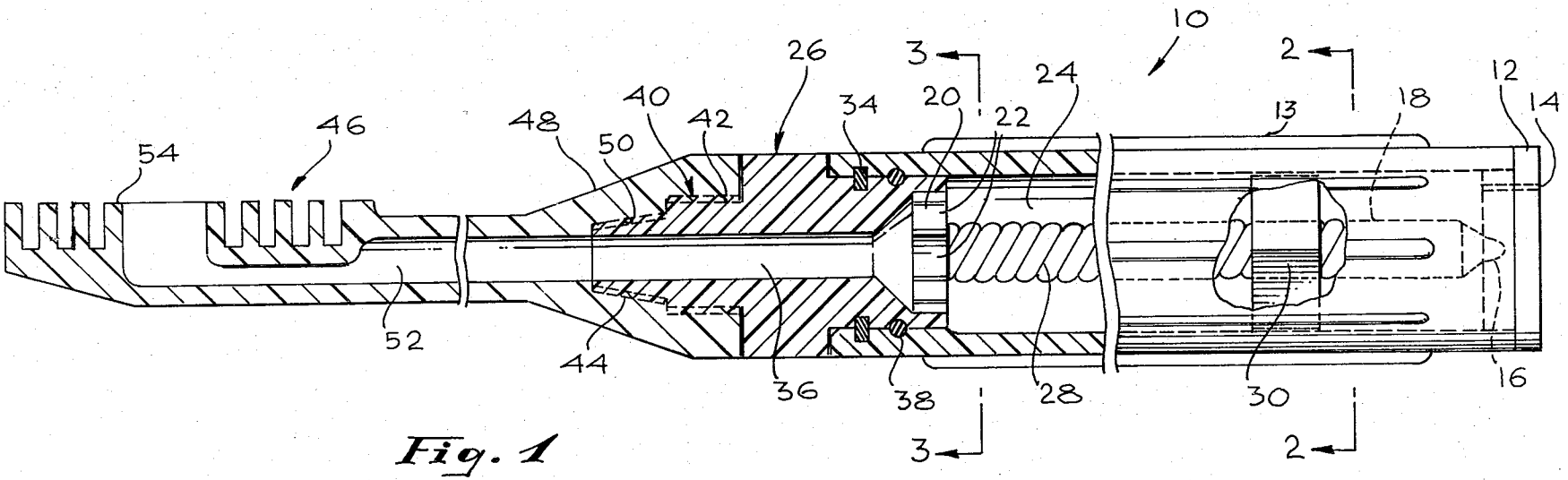
FIG. 1 is a partially cut-away drawing of a toothbrush with re-fillable paste reservoir, according to my invention.
Figure 3:
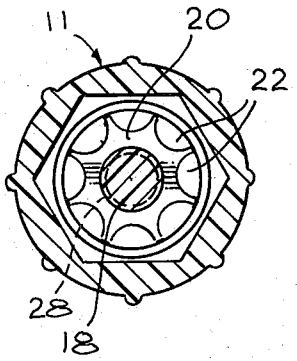
FIG. 3 is a cross-sectional view taken along line 3—3 in FIG. 1; and, FIG. 4 is a partially cross-sectioned view of my invention in the re-filling mode.
Figure 2:
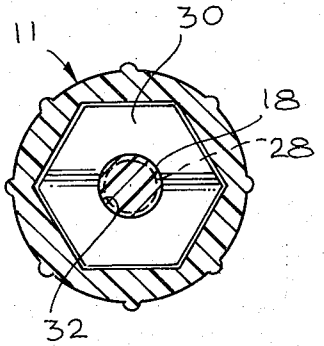
FIG. 2 is a cross-sectional view taken along lines 2—2 in FIG. 1.

In FIG. 1, reservoir 10 includes outer hollow cylinder or body 11 with end cap 12 closing off one end thereof. Body 11 carries longitudinal ribs 13 on its outer wall. End opening 14 is provided through end cap 12 to permit air to flow in and out of the space within body 11 immediately adjacent to end cap 12. End cap 12 also has an indentation 16 therein for receiving and supporting one end of threaded rod or worm 18. As is shown in FIG. 1, rod 18 may be conical in shape at its end which cooperates with indentation 16 so as to effect support of rod 18 at that end. The opposite end of threaded rod or worm 18 terminates in aperture plate 20 which has a plurality of channels 22 about the periphery thereof, as can be seen more thoroughly in FIG. 3, to permit the passage of toothpaste into and out of reservoir space 24. Aperture plate 20 is secured, as by sonic welding, to spout portion 26. Rod 18 is threaded, as shown in FIG. 1, the threads 28 extending the length of rod 18 to form the equivalent of a worm. The piston 30 has a peripheral shape or contour and is dimensioned so as to cooperate with the shape of the inner walls of body 11. This relationship can be seen more clearly in FIG. 2. Piston 30 fits slidably within the inner walls of body 11. Piston 30 has a centrally threaded opening 32, the threads of which are designed to cooperate with the threads appearing on rod 18. Because of peripheral contour of piston 30 is other than circular, for example hexagonal as shown in FIG. 2, rotation of body 11 will cause rotation of piston 30 and, since threaded rod 18 is fixed in position within body 11 and body 11 is rotatably affixed to spout portion 26 by ring 34, such rotation of body 11 will result in linear displacement of piston 30 within the inner space 24 of body 11 causing the volume of that space to be changed. As piston 30 moves toward aperture plate 20, any toothpaste within space 24 will be forced outwardly through channels 22 in aperture plate 20 and into channel 36 within spout portion 26. Contrary-wise, if the body 11 is rotated in the opposite direction, piston 30 will retreat towards end cap 12 increasing the volume of space 24 within body 11 so that toothpaste may be loaded into that space. O-ring 38 is provided to assure a liquid seal to prevent toothpaste from escaping other than through channels 22 in aperture plate 20. Spout portion 26 terminates at its outer end, that is, the end opposite to that connected to aperture plate 20, in a connector portion 40. Connector 40 has a large-diameter portion 42 and a smaller diameter portion 44, portion 44 being tapered, if desired, to simplify its insertion into a toothpaste tube opening. Both portions 42 and 44 carry male threads. Brush head portion 46 includes a connector section 48 having internal or female threads 50 dimensioned to cooperate with the male threads on larger diameter portion 42 of connector 40. In addition, brush head 46 has a channel 52 extending therethrough and terminating in bristle portion 54, as shown. With brush head 46 in position on spout 26, channels 52 and 36 are aligned.

Figure 4:
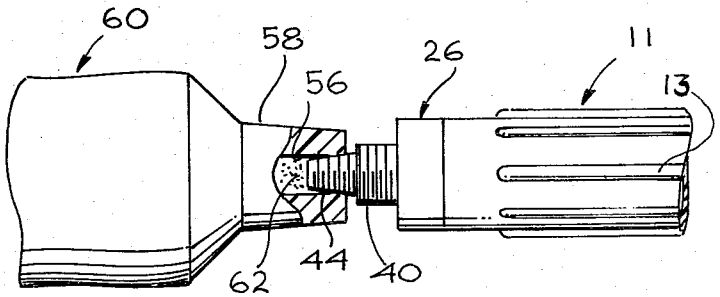

To fill the variable volume of space 24 in body 11, brush head 46 is removed from spout portion 26 by relative rotation between brush head 46 and body 11, smaller diameter portion 44 of connector 40 on spout 26 may be inserted within the opening 56 of the uncapped nozzle 58 on toothpaste tube 60, as shown in FIG. 4. The threads on portion 44 keep the tube 60 and the connector 40 in engagement as tube 60 is squeezed. At the onset of the filling process, body 11 has been rotated relative to spout portion 26 so that piston 30 has been retracted to a position proximate to end cap 12. Space 24 within body 11 is then of maximum volume.

As tube 60 is squeezed, toothpaste 62 flows out of tube 60 through channel 36 in spout portion 26, through apertures or channels 22 in aperture plate 20 and into the space 24 formed within the body 11 by the retraction of piston 30. Once chamber or space 24 has been filled with toothpaste, tube 60 is removed from portion 44 by rotation with respect to spout portion 26 in a direction opposite to that used to engage portion 44 in the inner opening 56 in toothpaste tube nozzle 58. Brush head 46 may then be attached to reservoir 10 by inserting connector portion 42 in the corresponding receiving portion of brush head 46. Relative rotation of brush head 46 and body 11 will cause a firm engagement of brush head 46 with connector portion 42 on spout 26.

To use the brush with the brush head so installed, brush head or spout portion 26 may be held with one hand and body 11 turned, for example clockwise, with the other hand to cause piston 30 to move away from end cap 12 towards aperture plate 20, thus forcing paste out of chamber 24 through apertures or channels 22 into channels 36, 52 and ultimately to bristle portion 54 of brush head 46. By this technique, the proper amount of toothpaste may be dispensed to the bristle portion 54 for optimum brush performance.

Reservoir 10 may be used in connection with multiple, selected brush heads 46. For example, each member of a family may have his separate brush head 46 to be selectively attached to a common reservoir 10.

While a particular embodiment of my invention has been shown and described, it will be evident to those skilled in the art that variations and modifications of that embodiment may be made without departing from the scope of my invention. It is the purpose of the appended claims to cover all those variations and modifications.

I claim:

1. A paste-dispensing toothbrush with a refillable reservoir, including:

a brush head, said brush head having a first connector portion and a bristle portion, said first connector portion having female threads of a first size and including a channel intercoupling said bristle portion with said connector portion;

a reservoir of variable volume, said reservoir including a hollow, cylindrical body portion having inner and outer walls and having an end-cap at one extremity thereof, said inner wall having a shape other than a circular shape;

a spout portion rotatably and coaxially connected to said body portion at the remaining extremity of said body portion, said spout portion having a second connector portion at the end thereof opposite that connected to said body portion, said second connector portion including a first section of a first diameter and a second section of a second diameter, both said first and second sections carrying male threads, said male threads on said first section being sized and shaped to cooperate with said female threads in said first connector portion of said brush head; said first diameter being larger than said second diameter and said second section being more remote from said end cap than said first section, said second diameter being sized to cause an interference fit of said second section with the inner wall of the nozzle of a toothpaste tube;

said spout portion having a coaxial channel therethrough aligned with said channel in said brush head when said brush head is in position on said spout portion;

an aperture plate, having apertures therethrough, supported fixedly and coaxially in said spout portion and transverse to and spanning the channel through said spout portion;

a threaded rod fixedly supported at its one end in said aperture plate and rotatably supported at its other end in said end cap in coaxial relationship with said body portion; and, a piston having a peripheral shape corresponding to the shape of the inner wall of said body portion and dimensioned to fit slidably within said body portion in transverse relationship to said body portion and coaxial therewith, said piston having a central opening therein sized and threaded to operatively engage said threaded rod, whereby, upon relative rotation between said spout portion and said body portion said piston moves axially along said threaded rod.

2. Apparatus according to claim 1 in which said second section of said second connector portion is tapered.

3. Apparatus according to claim 1 in which said inner wall of said body portion is hexagonal in its transverse shape.

4. Apparatus according to claim 1 in which body portion is secured to said spout portion by a ring.

5. Apparatus according to claim 4 which includes, in addition, an O-ring sealing the region between said body portion and said spout portion from the leakage of toothpaste therethrough.

6. Apparatus according to claim 1 in which said body portion carries longitudinal ribs on its outer wall.

7. Apparatus according to claim 1 in which said endcap has an air vent hole therethrough.

8. Apparatus according to claim 1 in which said endcap has a conically-shaped indentation therein to receive said threaded rod.

9. Apparatus according to claim 1 in which said apertures lie along the periphery of said aperture plate.

* * * * *